US006860072B2

(12) United States Patent
Smerud et al.

(10) Patent No.: US 6,860,072 B2
(45) Date of Patent: Mar. 1, 2005

(54) RETROFIT CASING HEAD APPARATUS AND METHOD

(75) Inventors: Richard J. Smerud, 3667 Camino Marglesa, Escondido, CA (US) 92065; Jennifer J. Sims, Encinitas, CA (US)

(73) Assignee: Richard J. Smerud, Escondido, CA (US)

( * ) Notice: Subject to any disclaimer, the term of this patent is extended or adjusted under 35 U.S.C. 154(b) by 21 days.

(21) Appl. No.: 10/443,370

(22) Filed: May 22, 2003

(65) Prior Publication Data

US 2004/0231253 A1 Nov. 25, 2004

(51) Int. Cl.[7] ..... E06B 1/00; E04B 1/32

(52) U.S. Cl. ..... 52/211; 52/86; 52/717.01; 52/745.16

(58) Field of Search ..... 52/86, 717.01, 52/745.15, 745.16, 211; D25/60, 136, 137

(56) References Cited

U.S. PATENT DOCUMENTS

| | | | | | |
|---|---|---|---|---|---|
| 97,548 | A | * | 12/1869 | Parkin et al. | 52/717.01 |
| 1,074,268 | A | | 9/1913 | Kelly et al. | |
| 1,619,631 | A | | 3/1927 | Patasnik | |
| 2,011,796 | A | | 8/1935 | Christensen | |
| D110,452 | S | * | 7/1938 | Baum | D25/60 |
| D110,453 | S | * | 7/1938 | Baum | D25/60 |
| D110,455 | S | * | 7/1938 | Baum | D25/60 |
| D110,456 | S | * | 7/1938 | Baum | D25/60 |
| D110,457 | S | * | 7/1938 | Baum | D25/60 |
| D119,744 | S | * | 4/1940 | Druckenmiller | D25/60 |
| 3,008,273 | A | | 11/1961 | Widin | |
| 4,400,917 | A | | 8/1983 | Massaro et al. | |
| 4,601,138 | A | | 7/1986 | Hampton | |
| 4,665,666 | A | | 5/1987 | Hampton | |
| 4,955,168 | A | | 9/1990 | Barry | |
| 5,459,974 | A | * | 10/1995 | Barry et al. | 52/745.08 |
| 5,572,834 | A | | 11/1996 | Lilly | |
| 5,584,148 | A | | 12/1996 | Barry et al. | |
| D424,210 | S | * | 5/2000 | Schiedegger et al. | D25/60 |
| 6,128,864 | A | | 10/2000 | Barry et al. | |
| 6,195,945 | B1 | | 3/2001 | McGarry et al. | |
| 6,401,405 | B1 | | 6/2002 | Hicks | |
| 2004/0068941 | A1 | * | 4/2004 | Smerud | 52/86 |

* cited by examiner

*Primary Examiner*—Robert Canfield
(74) *Attorney, Agent, or Firm*—Gordon & Rees LLP

(57) ABSTRACT

A retrofit casing head filler member has a front face, a rear face, an upper edge, a lower edge, and opposite side edges, and is designed for installation over a conventional arched casing head so as to cover any drywall regions exposed by removal of a rectangular casing head. The lower edge of the filler member has a predetermined radius of curvature matching the radius of curvature of the upper edge of the casing head. The filler member may be of reduced height in its central region and has a maximum height at its side edges to provide increased area in these regions to cover any exposed unfinished corners of the underlying drywall.

12 Claims, 2 Drawing Sheets

RETROFIT CASING HEAD APPARATUS AND METHOD

BACKGROUND OF THE INVENTION

The present invention relates generally to arched doorway and window openings, and is particularly concerned with a retrofit casing head apparatus and method for retrofitting a rectangular opening or doorway to provide an arched upper end or head for receiving an arched door or window.

Doors and windows with arched or curved upper edges are becoming a common and elegant design feature in new homes and other types of buildings. In order to provide an arched doorway in a building, all that is required is to install arch blocks in the upper corners of the doorway framing, add drywall around the opening, install upright jamb members and an arched upper jamb member in the opening, and hang the arched door in the opening. An outer casing is installed on the wall around the opening, normally on each side of the doorway. This comprises a pair of upright casing members and an arched casing head. A kit comprising the arched door, jamb members and casing members is normally provided to allow an arched doorway and door to be readily installed.

When it is desired to retrofit an existing, rectangular door and doorway with an arched door and doorway, the rectangular door and outer casing members are first removed from the doorway, exposing the existing doorway framing, which will include a straight upper cross member. Removal of the casing members will also expose, and may damage, the underlying unfinished drywall on the wall surfaces surrounding the doorway opening. Arch blocks can be installed at the upper corners of the rectangular opening to define an arched upper end to the doorway opening. Upright jamb members and an arched upper jamb member are then installed in the opening. An outer casing is then installed over the wall on each side of the opening, framing the opening. The problem with this technique is that unfinished or damaged regions of the drywall at the upper corners corresponding to the previous, rectangular casing will still be exposed after the arched upper casting head is installed, requiring re-finishing and painting of the drywall in these regions. This will be difficult and time consuming, particularly due to the requirement for matching the surrounding wall surface.

SUMMARY OF THE INVENTION

It is an object of the present invention to provide a new and improved retrofit casing head apparatus and method.

According to one aspect of the present invention, a retrofit casing head add-on device is provided, which comprises an elongate strip member having a front face and a rear face, an upper edge, a lower edge, and opposite side edges, the lower edge having a predetermined radius of curvature matching the radius of curvature of an upper edge of an arched casing head, the strip member being of varying height along its length, whereby the strip member may be installed over an arched casing head in a retrofit arched casing installation with the lower edge fitted flush against the upper edge of the casing head and the outer sides of the strip member substantially covering any corner void or exposed, unpainted portions of drywall above the upper corners of the arched casing head.

In an exemplary embodiment, the upper edge of the strip member is also curved but has a radius of curvature greater than that of the lower edge of the strip member, so as to provide an increased height at the outer side edges.

Alternatively, the upper edge may be straight. The front face of the strip member may be a smooth, flat face or may have decorative carvings or recesses. It will be suitably matched with the material and color of the conventional arched casing with which it is designed to be used, such that a substantially invisible transition is formed between the arched casing head and the add-on device.

The add-on device of this invention has the advantage that all other parts of the arched doorway installation can remain the same for any installation, including a retrofit. All that will be required for a retrofit is the purchase of a single, add-on member for use with a conventional arched doorway casing, making such installations relatively inexpensive and easy to complete. The add-on member is simply fastened to the wall above the conventional arched casing head, and will substantially cover any exposed unpainted drywall regions, such that minimal or no additional painting is required.

According to another aspect of the present invention, an arched casing apparatus for surrounding a doorway opening is provided, which comprises a pair of upright casing members for securing to the wall on each side of an opening, an arched casing head having opposite ends for securing to the upper ends of the upright casing members and extending over the wall surface at the top of an arched doorway opening, the casing head having a curved upper edge, and an arched filler member for installing on top of the arched casing head, the arched filler member having a lower edge of curvature matching that of the curved upper edge of the arched casing head, an upper edge, a central region, and opposite side edges, and the height of the filler member at the outer side edges being greater than the height at the central region, whereby the filler member will substantially cover any underlying, corner void or exposed unpainted drywall regions resulting from removal of a previously installed rectangular casing for a rectangular doorway.

The upper edge of the filler member may be straight or may be curved with a radius of curvature greater than that of the lower edge, such the height of the filler member will increase gradually from the central region up to the outer side edges, in order to provide sufficient thickness to cover any exposed regions at the corners previously covered by the removed rectangular casing assembly.

According to another aspect of the present invention, a method of retrofitting an arched casing apparatus around an arched doorway opening which has been formed in a previously constructed rectangular doorway opening is provided, which comprises the steps of:

- removing a previously installed rectangular casing apparatus from the wall surrounding a doorway opening, such that drywall regions are exposed beneath the upright casing members and rectangular casing head after their removal;
- modifying the opening to provide an arched upper end;
- installing upright casing members on the wall on each side of the doorway opening;
- installing an arched casing head on the wall above the arched upper end of the opening and extending between the upper ends of the upright casing members; and
- installing an arched filler member above the arched casing head, the filler member having outer side regions of increased height to cover corner portions of the exposed drywall regions revealed by removal of the rectangular casing apparatus.

The apparatus and method of this invention provide a convenient and inexpensive apparatus and method for use in retrofitting a rectangular doorway to provide an arched doorway for receiving a more attractive arched door. In an original building construction, arched doorways are constructed readily using a simple arched casing assembly in place of a conventional rectangular casing. This apparatus and method allows use of the conventional arched casing with a one piece add-on and filler member in order to retrofit an existing rectangular doorway in a previously constructed building. This will be very convenient for use in building remodels and the like.

BRIEF DESCRIPTION OF THE DRAWINGS

The present invention will be better understood from the following detailed description of an exemplary embodiment of the invention, taken in conjunction with the accompanying drawings in which like reference numerals refer to like parts and in which.

DETAILED DESCRIPTION OF THE DRAWINGS

Figure 1:
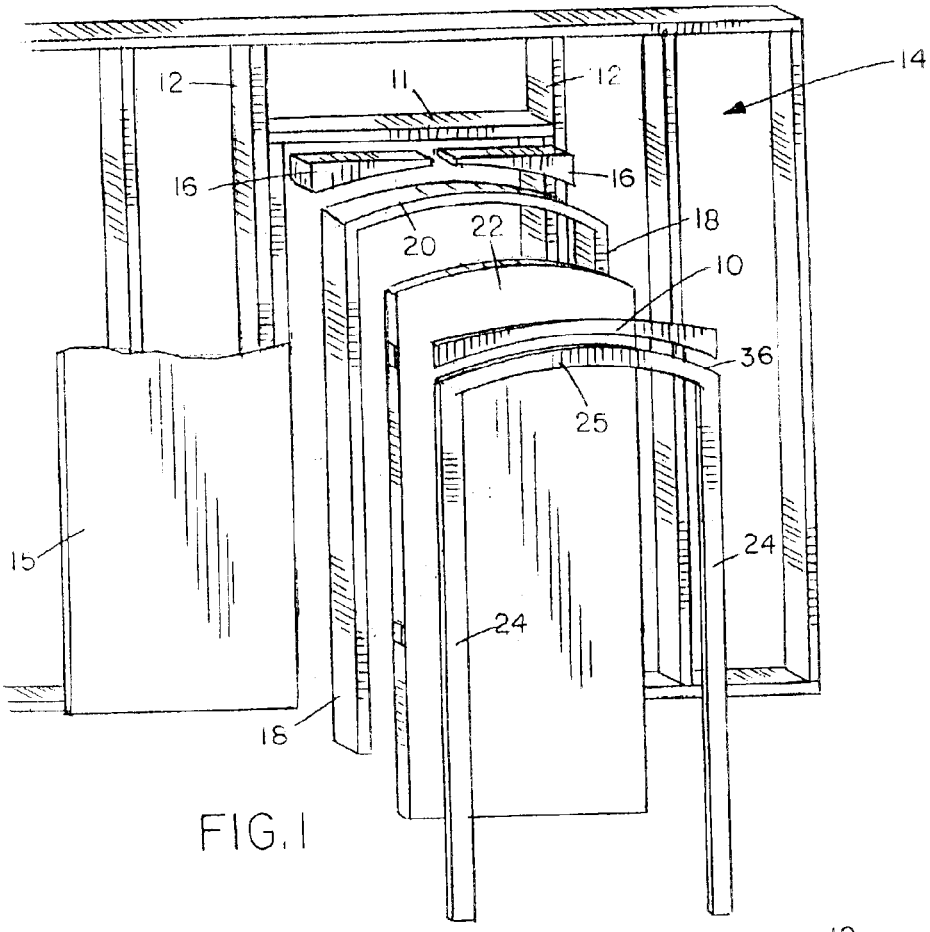
FIG. 1 is exploded perspective view of the arched casing retrofit components according to an exemplary embodiment of the invention.
Figure 2:
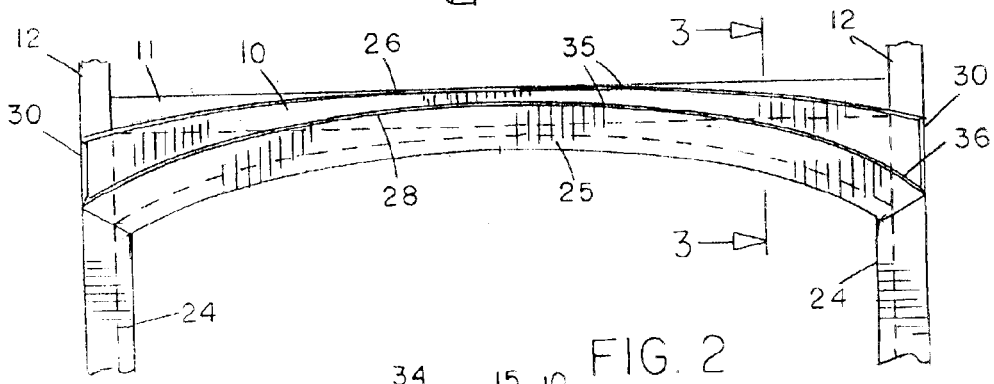
FIG. 2 is an enlarged front view of the arched casing head and filler member.
Figure 3:
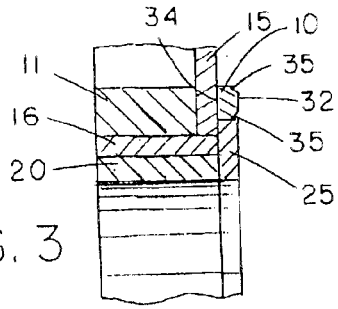
FIG. 3 is an enlarged sectional view taken on line 3–3 of FIG. 2.

FIGS. 1 to 3 of the drawings illustrate an arched filler member 10, retrofit arched casing apparatus using filler member 10, and a retrofit installation method according to an exemplary embodiment of the present invention. Currently, arched doorways and doors are considered to be more aesthetically pleasing than more conventional, rectangular or square doorway openings, and are often installed when new buildings are constructed. However, it is often desirable to retrofit an existing rectangular doorway and door to provide an arched doorway and door, when remodeling older buildings. It will be understood that a similar method and apparatus may be used to retrofit other rectangular building openings, such as windows.

As illustrated in FIG. 1, a typical rectangular doorway opening is formed by installing a straight cross member 11 between two upright members 12 of the wall framing 14. Upright jamb members 13 are installed on each side of the opening. Drywall 15 is then applied over the framing. If the doorway is rectangular, a rectangular door is hung in the opening, and a rectangular casing is typically installed over the drywall on each side of the doorway, so as to form an attractive frame for the doorway. The walls will then be finished and painted.

In order to form an arched doorway in an original building construction, arched corner blocks 16 are secured in the rectangular doorway beneath the straight cross member 10. Upright jamb members 18 and an arched upper jamb member 20 are then secured in the doorway opening to provide a frame for the arched door 22, which is then secured to one side jamb member 18 via hinges. An arched casing assembly is then secured on top of the drywall 15 so as to surround the doorway. The conventional arched casing assembly comprises a pair of upright casing members 24 and an arched casing head 25 extending between the upper ends of the casing members 24. Thus, parts 24 and 25 of FIG. 1 are typically provided in a conventional arched casing assembly for a doorway.

The conventional arched casing assembly has problems when it is used in remodeling of a square or rectangular doorway to provide an arched doorway for an arched door of more modern style. As noted above, such a doorway will originally have a surround or casing framing the doorway and comprising a pair of upright casing members and a straight casing head or cross member extending between the upper ends of the casing members. These will be attached directly on top of the finished drywall prior to painting of the surrounding wall. In order to convert a rectangular doorway into an arched doorway, the rectangular casing surrounding the doorway must be removed, exposing a corner void inside the frame and a rectangular frame region of rough, unpainted drywall. After forming the arched opening by installing the arched corner blocks 16 and arched jamb assembly 18,20, a casing or surround assembly must be installed on the wall surrounding the door, normally on both sides of the doorway. If a conventional arched casing assembly 24,25 is installed, corner voids and finished but rough drywall corner regions will be exposed above the arched casing head 25 at each side. In order to deal with this problem, the arched filler or add-on member 10 is secured above the casing head 25 so as to substantially cover any exposed unpainted regions.

The arched filler member 10 comprises a generally flat strip of suitable material such as wood or the like matching the material of the arched casing head 25, having an upper arched edge 26, a lower arched edge 28, opposite, straight side edges 30, a front face 32, and a rear face 34. The front face 32 may have bevels 35 at the junction with the upper, lower, and side edges, as best illustrated in FIG. 2. It may also be provided with decorative carvings or indicia (not illustrated), which may match those on the arched casing head.

The lower edge 28 of the filler member 10 has a radius of curvature matching that of the upper edge 36 of the arched casing head 25, so that it fits flush against the upper edge as indicated in FIG. 2. The upper edge 26 of member 10 has a radius of curvature larger than that of lower edge 28, such that the height of the filler member increases from the central region out to the opposite side edges 30, which are designed to extend vertically when the filler member is installed over the casing head 25 as in FIG. 2. The increased height at the outer side edges ensures that the outer side regions of the filler member will substantially cover any finished but rough and unpainted drywall regions which have been exposed by removal of a previously installed rectangular casing assembly, so that no further or only minimal finishing is required.

It will be understood that the difference in radius of curvature between the lower edge and upper edge of the filler member 10 will vary dependent on the width of the door opening and the desired height of the side edge 30 of the filler member, i.e. how much additional coverage is required at the corners to conceal any unfinished wall regions. The radius of curvature of the lower edge 28 must match that of the upper edge of the casing head 25 with which it is to be used. Filler members may be provided in a range of different sizes with different curvatures at the lower and upper edges for different doorway installations. In one exemplary embodiment of the invention for a single door opening of two foot width, the radius of curvature of the lower edge 28 was around 24.8 inches, while the radius of curvature of the upper edge was around 43.9 inches, and the height of each side edge 30 was around 3.8 inches. The height at the center of the filler member was around 1.5 inches. However, for this size door opening, the lower edge radius will typically be in the range from 23 to 26 inches, while the radius of the upper edge will be in the range from 42 to 45 inches. For door openings of width 2 foot 4 inches, the radius of the lower edge was around 32 inches, while the radius of the upper edge was around 56 inches, and the height of the side edge 30 was around 3.66 inches. For a door opening width of 2 foot 6 inches, the lower edge radius was around 36.3 inches while the upper edge radius was around 63.1 inches, and the height at the side edge was around 3.6 inches. For a double door opening of around 5 foot width, the lower edge radius was around 132.3 inches and the upper edge radius was around 212 inches, with a side edge height of around 3.1 inches. In each case, the height at the center was around 1.5 inches, although this dimension may be varied in some cases. For a single door opening, the radius of curvature of the lower edge is in the range from 20 inches to 40 inches, while the radius of curvature of the upper edge is in the range from 40 inches to 65 inches.

Figure 4:
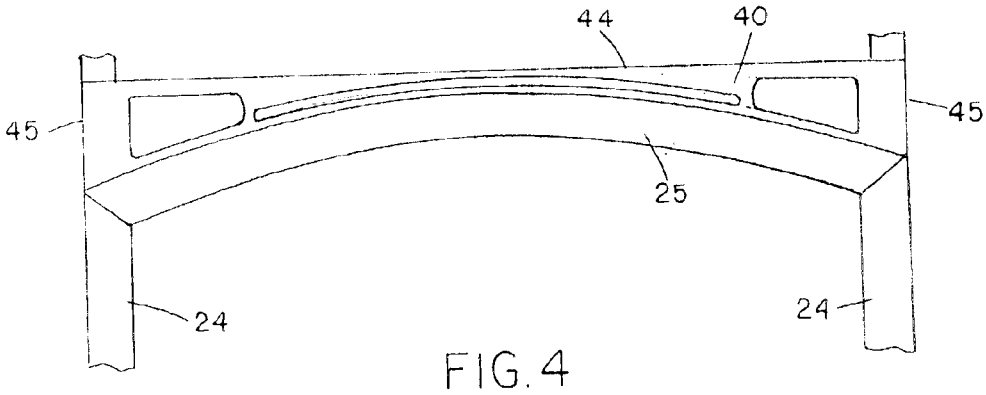
FIG. 4 is a front view similar to FIG. 2 illustrating an alternative filler member.
Figure 5:
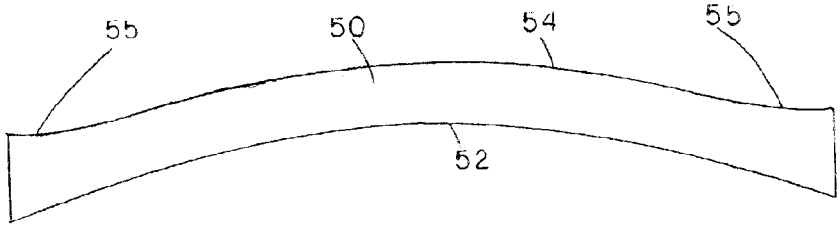
FIG. 5 is a view similar to FIGS. 2 and 4 illustrating another alternative filler member.

FIGS. 4 and 5 illustrate some alternative filler members 40,50 which are shaped in a different manner to provide the increased thickness required to cover unfinished drywall regions in an arched doorway retrofit. The arched filler member 40 of FIG. 4 has an arched lower edge 42 for mating with the arched upper edge 36 of the casing head 25. However, the upper edge 44 in this case is straight rather than arched as in the previous embodiment. It can be seen that this still provides increased height at the outer side edges 45, while producing a different decorative effect. The filler member 40 of FIG. 4 is also shown with decorative carvings or grooves 46 in its front face, which may be provided in any embodiments.

In FIG. 5, the filler member 50 again has an arched lower edge 52 of curvature matching that of the upper edge 36 of the arched casing head. In this case, the upper edge 54 has a radius of curvature matching that of the lower edge 52 along most of its length, but has a reverse curve adjacent each outer side edge for forming ears 55 which provide the necessary increased area in these regions for covering any corner voids and exposed drywall regions, while at the same time producing a different decorative effect.

The add-on or filler member or modified arched casing head of this invention considerably simplifies the process of retrofitting a rectangular doorway opening to provide an arched doorway. The filler member allows the same basic, off-the-shelf components as used in an original arched doorway installation during construction to be used in a retrofit of an existing building, simply by adding the filler member, which is nailed to the wall above the casing head. All that is required is the purchase of a relatively inexpensive and easily installed filler member.

Although some exemplary embodiments of the invention have been described above by way of example only, it will be understood by those skilled in the field that modifications may be made to the disclosed embodiments without departing from the scope of the invention, which is defined by the appended claims.

We claim:

1. An arched casing apparatus for surrounding an arched building opening, comprising:

a pair of upright casing members for securing to the wall on each side of an opening;

an arched casing head having opposite ends for securing to the upper ends of the upright casing members and extending over the wall surface at the top of an arched building opening, the casing head having a curved upper edge; and an arched filler member for installing on top of the arched casing head, the arched filler member having a lower edge of curvature matching that of the curved upper edge of the arched casing head, an upper edge, a central region, and opposite side edges, and the height of the filler member at the outer side edges being greater than the height at the central region, whereby the filler member will substantially cover any underlying, unpainted drywall regions exposed by removal of a previously installed rectangular casing for a rectangular opening.

2. The apparatus as claimed in claim 1, wherein the upper edge of the filler member is curved with a radius of curvature greater than that of the lower edge, such the height of the filler member will increase gradually from the central region up to the outer side edges.

3. The apparatus as claimed in claim 2, wherein the radius of curvature of the lower edge of the filler member is in the range from 20 inches to 40 inches and the radius of curvature of the upper edge of the filler member is in the range from 40 inches to 65 inches.

4. The apparatus as claimed in claim 1, wherein the upper edge of the filler member is straight.

5. The apparatus as claimed in claim 1, wherein the upper edge of the filler member has a central, curved portion having a radius of curvature which is substantially the same as that of the lower edge, and upwardly projecting ear portions adjacent the side edges for covering any unfinished drywall regions.

6. The apparatus as claimed in claim 1, wherein the height of each side edge of the filler member is in the range from 2 inches to 4 inches.

7. The apparatus as claimed in claim 6, wherein the height of each side edge is in the range from 3 inches to 3.9 inches.

8. The apparatus as claimed in claim 1, wherein the filler member has a center region of approximately 1.5 inches in height.

9. An arched casing apparatus for surrounding an arched opening in a building, comprising:

a pair of upright casing members for securing to the wall on each side of an opening;

an arched casing head having opposite ends for securing to the upper ends of the upright casing members and extending over the wall surface at the top of an arched opening, the casing head having a curved upper edge; and an arched filler member for installing on top of the arched casing head, the arched filler member having a curved lower edge of curvature matching that of the curved upper edge of the arched casing head, and a curved upper edge having a radius of curvature greater than that of the lower edge, a central region, and opposite side edges, and the height of the filler member at the outer side edges being greater than the height at the central region, whereby the filler member will substantially cover any underlying unpainted drywall regions resulting from removal of a previously installed rectangular casing assembly.

10. A retrofit casing head add-on device, comprising:

an elongate strip member having a front face and a rear face, an upper edge, a lower edge, and opposite side edges, the lower edge having a predetermined radius of curvature matching the radius of curvature of an upper edge of an arched casing head;

the strip member being of varying height along its length, whereby the strip member may be installed over an arched casing head in a retrofit arched casing installation with the lower edge fitted flush against the upper edge of the casing head and the outer sides of the strip member substantially covering any exposed unpainted portions of drywall above the upper corners of the arched casing head; and the upper edge of the strip member having a central, convex curved portion having a radius of curvature which is substantially the same as that of the lower edge, and concave portions extending from the central portion to form upwardly projecting ear portions at the side edges.

11. The device as claimed in claim 10, wherein the outer side edges of the strip member are straight edges which extend vertically when the device is installed over an arched casing head.

12. A method of retrofitting an arched casing assembly around an arched opening which has been formed in a previously constructed rectangular opening, comprising the steps of:

removing a previously installed rectangular casing assembly from the wall surrounding an opening in a building, such that drywall regions are exposed beneath the upright casing members and rectangular casing head after their removal;

modifying the opening to provide an arched upper end;

installing upright casing members on the wall on each side of the opening;

installing an arched casing head on the wall above the arched upper end of the opening and extending between the upper ends of the upright casing members; and installing an arched filler member above the arched casing head, the filler member having outer side regions of increased height to cover corner portions of the exposed drywall regions revealed by removal of the rectangular casing assembly.

* * * * *